US007410413B2

(12) United States Patent
Woo et al.

(10) Patent No.: US 7,410,413 B2
(45) Date of Patent: Aug. 12, 2008

(54) STRUCTURED ABRASIVE ARTICLE AND METHOD OF MAKING AND USING THE SAME

(75) Inventors: Edward J. Woo, Woodbury, MN (US); Craig F. Lamphere, Woodbury, MN (US); Gregory A. Koehnle, Oakdale, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 321 days.

(21) Appl. No.: 11/380,444

(22) Filed: Apr. 27, 2006

(65) Prior Publication Data

US 2007/0254560 A1 Nov. 1, 2007

(51) Int. Cl.
*B24D 11/00* (2006.01)

(52) U.S. Cl. ..... 451/527; 451/529; 451/531; 451/539; 51/298

(58) Field of Classification Search ..... 451/259, 451/526, 527, 528, 529, 530, 531, 533, 539; 51/298, 300
See application file for complete search history.

(56) References Cited

U.S. PATENT DOCUMENTS

| | | | |
|---|---|---|---|
| 2,242,877 | A | 5/1941 | Albertson |
| 4,111,666 | A | 9/1978 | Kalbow |
| 4,311,489 | A | 1/1982 | Kressner |
| 4,609,581 | A | 9/1986 | Ott |
| 4,652,274 | A | 3/1987 | Boettcher et al. |
| 4,652,275 | A | 3/1987 | Bloecher et al. |
| 4,735,632 | A | 4/1988 | Oxman et al. |
| 4,751,138 | A | 6/1988 | Tumey et al. |
| 4,799,939 | A | 1/1989 | Bloecher et al. |
| 4,903,440 | A | 2/1990 | Kirk et al. |
| 4,985,340 | A | 1/1991 | Palazzotto et al. |
| 5,014,468 | A | 5/1991 | Ravipati et al. |
| 5,015,266 | A | 5/1991 | Yamamoto |
| 5,086,086 | A | 2/1992 | Brown-Wensley et al. |
| 5,152,917 | A | 10/1992 | Pieper et al. |
| 5,190,568 | A | 3/1993 | Tselesin |
| 5,219,462 | A | 6/1993 | Bruxvoort et al. |
| 5,236,472 | A | 8/1993 | Kirk et al. |
| 5,254,194 | A | 10/1993 | Ott et al. |
| 5,286,782 | A | 2/1994 | Lamb et al. |
| 5,354,797 | A | 10/1994 | Anderson et al. |
| 5,376,428 | A | 12/1994 | Palazzotto et al. |
| 5,385,954 | A | 1/1995 | Palazzotto et al. |

(Continued)

OTHER PUBLICATIONS

"Conformable Abrasive Articles and Methods of Making and Using the Same", U.S. Appl. No. 11/232,834, filed Sep. 22, 2005.

(Continued)

*Primary Examiner*—Eileen P. Morgan
(74) *Attorney, Agent, or Firm*—Bradford B. Wright

(57) ABSTRACT

A structured abrasive article comprises a backing, a structured abrasive layer affixed to the backing, the structured abrasive layer comprising: a plurality of raised abrasive regions, each raised abrasive region consisting essentially of a close-packed plurality of pyramidal abrasive composites; and a network consisting essentially of close-packed truncated pyramidal abrasive composites, wherein the network continuously abuts and separates the raised abrasive regions from one another. The height of the pyramidal abrasive composites is greater than the height of the truncated pyramidal abrasive composites. Methods of making and using the same are also disclosed.

13 Claims, 5 Drawing Sheets

U.S. PATENT DOCUMENTS 5,435,816 A 7/1995 Spurgeon et al.
5,454,844 A 10/1995 Hibbard et al.
D366,365 S 1/1996 Hoopman
5,489,235 A 2/1996 Gagliardi
5,672,097 A 9/1997 Hoopman
5,672,186 A 9/1997 Chesley et al.
5,681,217 A 10/1997 Hoopman et al.
5,709,598 A 1/1998 Nishio et al.
5,733,178 A 3/1998 Ohishi
5,833,724 A 11/1998 Wei et al.
5,851,247 A 12/1998 Stoetzel et al.
5,863,306 A 1/1999 Wei et al.
5,908,476 A 6/1999 Nishio et al.
5,975,987 A 11/1999 Hoopman et al.
6,048,375 A 4/2000 Yang et al.
6,139,402 A 10/2000 Moore
6,139,594 A 10/2000 Kincaid et al.
6,277,160 B1 * 8/2001 Stubbs et al. ..... 51/295
6,293,980 B2 9/2001 Wei et al.
6,371,842 B1 4/2002 Romero
6,375,559 B1 4/2002 James et al.
6,419,574 B1 * 7/2002 Takahashi et al. ..... 451/548
6,428,898 B1 8/2002 Barsotti et al.
6,544,306 B2 4/2003 Suzuki et al.
6,544,593 B1 4/2003 Nagata et al.
6,613,113 B2 9/2003 Minick et al.
6,652,370 B2 11/2003 Moore
6,705,935 B2 3/2004 Kuramochi et al.
6,773,475 B2 * 8/2004 Ohishi ..... 51/298
6,821,189 B1 11/2004 Coad et al.
6,846,232 B2 1/2005 Braunschweig et al.
6,929,539 B2 8/2005 Schutz et al.
6,949,128 B2 9/2005 Annen
6,969,412 B2 11/2005 Welygan et al.
2001/0041511 A1 11/2001 Lack et al.
2002/0077037 A1 6/2002 Tietz
2003/0022604 A1 1/2003 Annen et al.
2003/0143938 A1 7/2003 Braunschweig et al.
2003/0207659 A1 11/2003 Annen et al.
2004/0082288 A1 4/2004 Tietz et al.
2005/0060942 A1 3/2005 Culler et al.
2005/0113005 A1 5/2005 Woo et al.

OTHER PUBLICATIONS

"Flexible Abrasive Article and Methods of Making and Using the Same", U.S. Appl. No. 11/233,250, filed Sep. 22, 2005.
"Embossed Structured Abrasive Article and Method of Making and Using the Same", U.S. Appl. No. 11/379,087, filed Apr. 18, 2006.

* cited by examiner

STRUCTURED ABRASIVE ARTICLE AND METHOD OF MAKING AND USING THE SAME

BACKGROUND

For years, a class of abrasive articles known generically as "structured abrasive articles" has been sold commercially for use in surface finishing. Structured abrasive articles have a structured abrasive layer affixed to a backing, and are typically used in conjunction with a liquid such as, for example, water, optionally containing surfactant. The structured abrasive layer has a plurality of shaped abrasive composites (typically having minute size), each having abrasive particles dispersed a binder. In many cases, the shaped abrasive composites are precisely shaped, for example, according to various geometric shapes (e.g., pyramids). Examples of such structured abrasive articles include those marketed under the trade designation "TRIZACT" by 3M Company, St. Paul, Minn.

Structured abrasive articles are often used in combination with a backup pad mounted to a tool (e.g., a disk sander or a random orbit sander). In such applications, structured abrasive articles typically have an attachment interface layer (e.g., a hooked film, looped fabric, or adhesive) that affixes them to the back up pad during use.

Conventional structured abrasive articles often have problems with "stiction", the tendency for the abrasive surface to stick to a workpiece when used in the damp abrading processes typical of industry. To reduce stiction, one solution has been to provide uncoated regions on the backing that separate regions of close-packed shaped abrasive composites; however, during manufacturing this approach can lead to aberrations in the structured abrasive layer (e.g., extraneous abrasive material weakly attached to the shaped abrasive composites as shown, for example, in FIG. 6) that result in wild scratches in a workpiece during use.

SUMMARY

In one aspect, the present invention relates to a structured abrasive article comprising:

a backing having first and second opposed major surfaces; and a structured abrasive layer having an outer boundary and affixed to the first major surface of the backing, the structured abrasive layer comprising:

a plurality of raised abrasive regions, each raised abrasive region consisting essentially of close-packed pyramidal abrasive composites having a first height;

a network consisting essentially of close-packed truncated pyramidal abrasive composites having a second height, wherein the network continuously abuts and separates the raised abrasive regions from one another and is coextensive with the outer boundary;

wherein the pyramidal abrasive composites and the truncated pyramidal abrasive composites each comprise abrasive particles and a binder, and wherein the first height is greater than the second height.

In another aspect, the present invention relates to a method of abrading a workpiece, the method comprising:

a) providing an embossed structured abrasive article according to the present invention;

b) providing a workpiece;

c) frictionally contacting at least a portion of the structured abrasive layer with at least a portion of the workpiece; and d) moving at least one of the workpiece and the structured abrasive layer relative to the other to abrade at least a portion of the surface of the workpiece.

In another aspect, the present invention relates to a method of making a structured abrasive article, the method comprising:

providing a backing having first and second opposed major surfaces;

providing an abrasive slurry, the abrasive slurry comprising a plurality of abrasive particles dispersed in a binder precursor;

providing a production tool having a major surface and an outer boundary, the major surface comprising:

a plurality of recessed regions, each recessed region consisting essentially of close-packed pyramidal cavities having a first depth; and a network consisting essentially of close-packed truncated pyramidal cavities having a second depth, wherein the network continuously abuts and separates the recessed regions from one another and is coextensive with the outer boundary, and wherein the depth of the pyramidal cavities is greater than the depth of the truncated pyramidal abrasive cavities;

urging the abrasive slurry against the major surface such that the abrasive slurry fills at least a portion of the pyramidal cavities and truncated pyramidal cavities;

contacting the first major surface of the backing with abrasive slurry in the pyramidal cavities and truncated pyramidal cavities;

at least partially curing the binder precursor to form a binder, thereby forming a plurality of pyramidal abrasive composites and truncated pyramidal abrasive composites adhered to the backing; and separating the first major surface of the backing from the production tool.

Structured abrasive articles according to the present invention typically exhibit relatively low stiction during abrading processes, have desirable wear profile characteristics, and are readily manufacturable by continuous methods and with a low defect rate.

As used herein:

"abrasive composite" refers to a particle of abrasive grains dispersed in an organic binder;

"close-packed" means that base of each pyramidal abrasive composite (or opening of each cavity) abuts adjacent pyramidal abrasive composites (or cavities), truncated or not, along its entire circumference, except at the perimeter of the abrasive layer or mold where of course this would not be possible;

"consisting essentially of close-packed abrasive composites " (e.g., truncated pyramidal abrasive composites or pyramidal abrasive composites) means that while a degree of variation (e.g., in height, shape, or density) is encompassed (e.g., as arising from the manufacturing process used), that variation cannot materially affect the abrasive properties of the structured abrasive article (e.g., cut, product life, or smoothness of the resultant surface finish); and "consisting essentially of close-packed cavities" (e.g., truncated pyramidal cavities or pyramidal cavities) means that while a degree of variation (e.g., in depth, shape, or density) is encompassed (e.g., as arising from the manufacturing process used), that variation cannot materially affect the abrasive properties of the resultant structured abrasive article (e.g., cut, product life, or smoothness of the resultant surface finish).

DETAILED DESCRIPTION

Figure 1A:
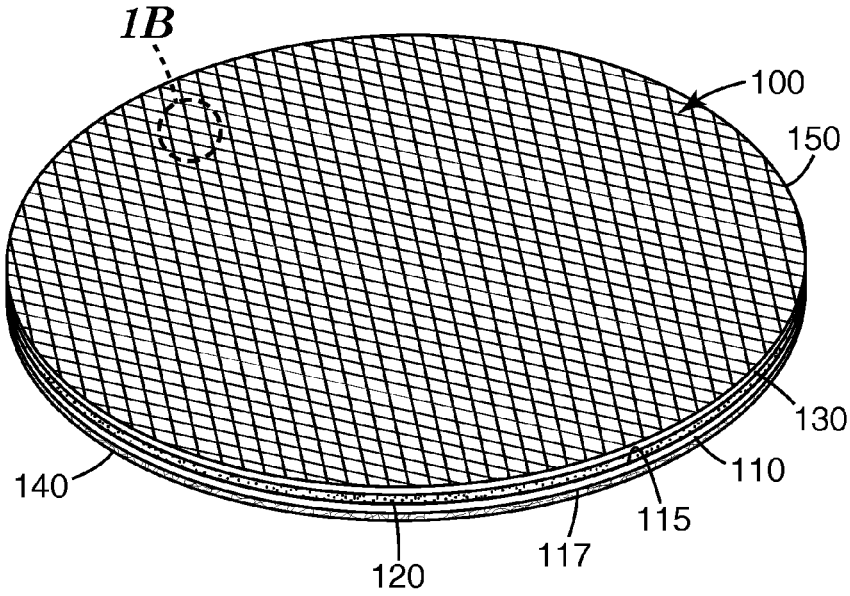
FIG. 1A is a perspective view of an exemplary structured abrasive disk according to the present invention.
Figure 1C:
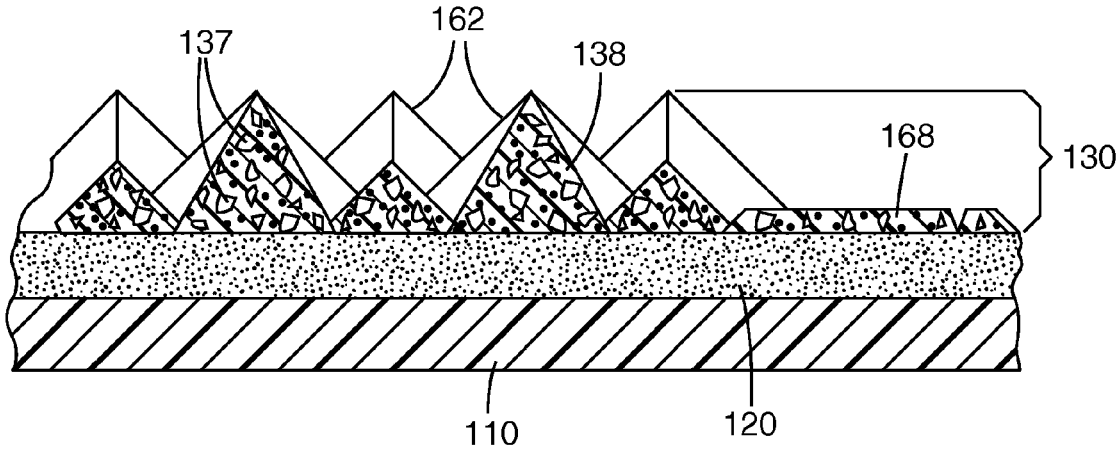
FIG. 1C is a further enlarged cross-sectional view of a portion of structured abrasive disk 100 shown in FIG. 1B that shows the structured abrasive layer in greater detail.
Figure 1B:
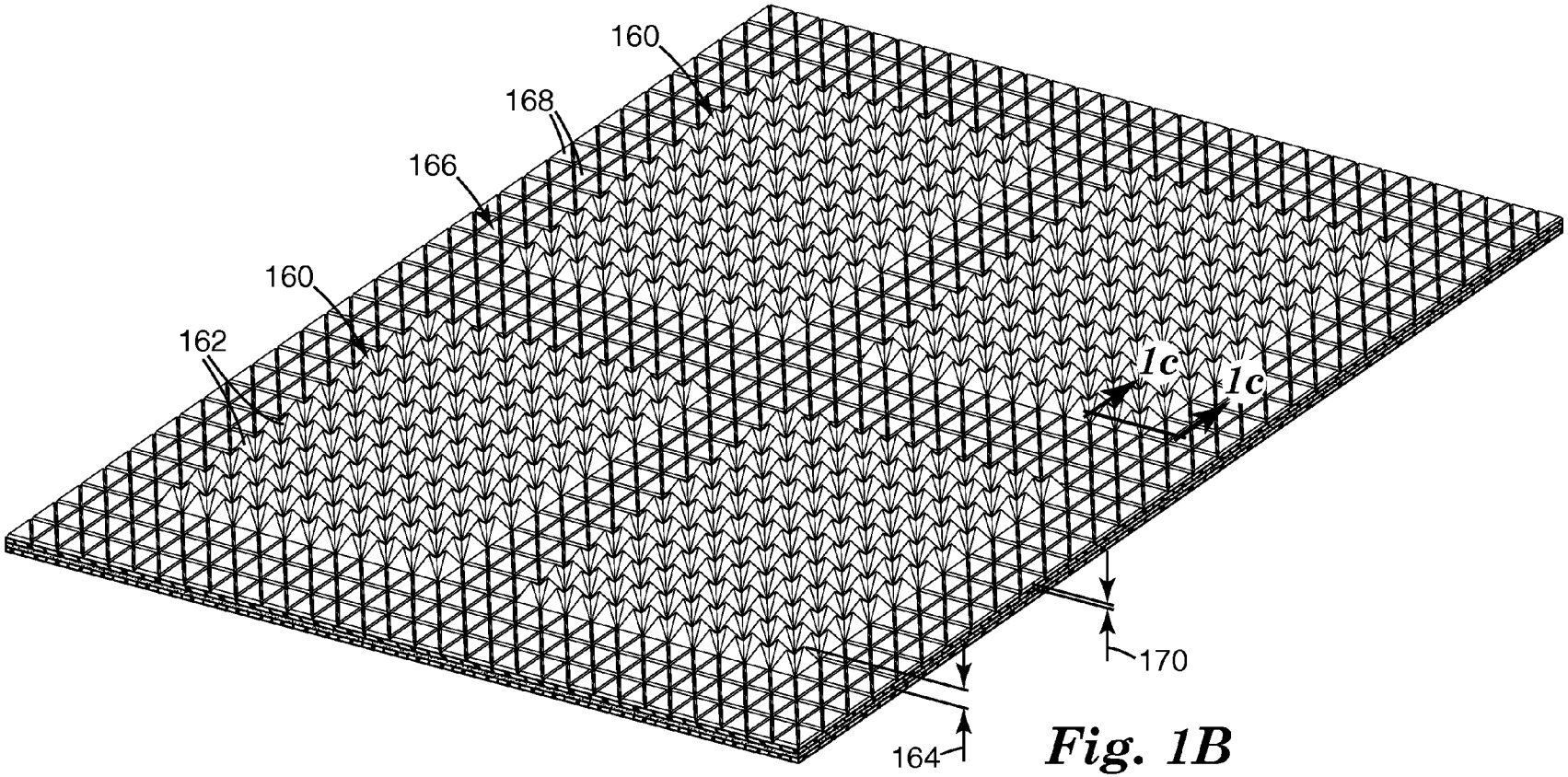
FIG. 1B is an enlarged view of a portion of structured abrasive disk 100 shown in FIG. 1A that shows the structured abrasive layer in greater detail.

Structured abrasive articles according to the present invention comprise a structured abrasive layer affixed to a first major surface of a backing. An exemplary structured abrasive article is shown in FIGS. 1A-1C. Referring now to FIG. 1A, exemplary structured abrasive disk 100 has backing 110 with first and second major surfaces, 115 and 117, respectively. Optional adhesive layer 120 contacts and is affixed to and coextensive with first major surface 115. Structured abrasive layer 130 has outer boundary 150 and contacts and is affixed to and coextensive with, either first major surface 115 of backing 110 (if optional adhesive layer 120 is not present) or optional adhesive layer 120 (if present). As shown in FIG. 1B, structured abrasive layer 130 comprises a plurality of raised abrasive regions 160 and network 166. Each raised abrasive region 160 consists essentially of a close-packed plurality of pyramidal abrasive composites 162 having a first height 164. Network 166 consists essentially of close-packed truncated pyramidal abrasive composites 168 having a second height 170. Network 166 continuously abuts and separates raised abrasive regions 160 from one another and is coextensive with outer boundary 150. The height 164 of pyramidal abrasive composites 162 is greater than the height 170 of the truncated pyramidal abrasive composites 168. Optional mechanical attachment interface layer 140 is affixed to second major surface 117. Referring now to FIG. 1C, pyramidal abrasive composites 162 and truncated pyramidal abrasive composites 168, each comprise abrasive particles 137 and binder 138.

It is discovered that the combination of pyramidal abrasive composites and a network of truncated pyramidal abrasive composites according to the present invention typically facilitates waste (e.g., swarf) removal and effectively captures dust nibs, increases the proportion of frictional pressure distributed to the pyramidal composites during abrading processes (particularly helpful in manual abrading processes), reduces stiction, and facilitates manufacturing by avoiding extraneous cured abrasive slurry pieces that can lead to wild scratches in a workpiece during abrading processes.

Suitable backings include, for example, polymeric films (including primed polymeric film), cloth, paper, foraminous and non-foraminous polymeric foam, vulcanized fiber, fiber reinforced thermoplastic backing, meltspun or meltblown nonwovens, treated versions thereof (e.g., with a waterproofing treatment), and combinations thereof. Suitable thermoplastic polymers for use in polymeric films include, for example, polyolefins (e.g., polyethylene, and polypropylene), polyesters (e.g., polyethylene terephthalate), polyamides (e.g., nylon-6 and nylon-6,6), polyimides, polycarbonates, blends thereof, and combinations thereof.

Typically, at least one major surface of the backing is smooth (for example, to serve as the first major surface).

The second major surface of the backing may comprise a slip resistant or frictional coating. Examples of such coatings include an inorganic particulate (e.g., calcium carbonate or quartz) dispersed in an adhesive.

The backing may contain various additive(s). Examples of suitable additives include colorants, processing aids, reinforcing fibers, heat stabilizers, UV stabilizers, and antioxidants. Examples of useful fillers include clays, calcium carbonate, glass beads, talc, clays, mica, wood flour; and carbon black. In some embodiments, the backing may be a composite film such as, for example, a coextruded film having two or more discrete layers.

The structured abrasive layer has pyramidal abrasive composites arrayed in a close-packed arrangement to form raised abrasive regions. The raised abrasive regions are typically identically shaped and arranged on the backing according to a repeating pattern, although neither of these is a requirement.

The term pyramidal abrasive composite refers to an abrasive composite having the shape of a pyramid, that is, a solid figure with a polygonal base and triangular faces that meet at a common point (apex). Examples of types of suitable pyramid shapes include three-sided, four-sided, five-sided, six-sided pyramids, and combinations thereof. The pyramids may be regular (that is, all sides the same) or irregular. The height of a pyramid is the least distance from the apex to the base.

The term truncated pyramidal abrasive composite refers to an abrasive composite having the shape of a truncated pyramid, that is, a solid figure with a polygonal base and triangular faces that meet at a common point, wherein the apex is cut off and replaced by a plane that is parallel to the base. Examples of types of suitable truncated pyramid shapes include three-sided, four-sided, five-sided, six-sided truncated pyramids, and combinations thereof. The truncated pyramids may be regular (that is, all sides the same) or irregular. The height of a truncated pyramid is the least distance from the apex to the base.

For fine finishing applications, the height of the pyramidal abrasive composites (i.e., not truncated) is generally greater than or equal to 1 mil (25.4 micrometers) and less than or equal to 20 mils (510 micrometers); for example, less than 15 mils (380 micrometers), 10 mils (250 micrometers), 5 mils (130 micrometers), 2 mils (50 micrometers), although greater and lesser heights may also be used.

A continuous network consisting essentially of close-packed truncated pyramidal abrasive composites continuously abuts and separates the raised abrasive regions from one another. As used herein, the term "continuously abuts" means that the network is proximal to each of the raised abrasive portions, for example, in a close-packed arrangement of truncated pyramidal abrasive composites and pyramidal abrasive composites. The network may be formed along straight lines, curved lines, or segments thereof, or a combination thereof. Typically, the network extends throughout the structured abrasive layer; more typically, the network has a regular arrangement (e.g., a network of intersecting parallel lines or a hexagonal pattern). In some embodiments, the network has a least width of at least twice the height of the pyramidal abrasive composites.

The ratio of the height of the truncated pyramidal abrasive composites to the height of the pyramidal abrasive composites is less than one, typically in a range of from at least 0.05, 0.1, 0.15, or even 0.20 up to and including 0.25, 0.30, 0.35, 0.40, 0.45, 0.5 or even 0.8, although other ratios may be used. More typically, the ratio is in a range of from at least 0.20 up to and including 0.35.

For fine finishing applications, the areal density of the pyramidal and/or truncated pyramidal abrasive composites in the structured abrasive layer is typically in a range of from at least 1,000, 10,000, or even at least 20,000 abrasive composites per square inch (e.g., at least 150, 1,500, or even 7,800 abrasive composites per square centimeter) up to and including 50,000, 70,000, or even as many as 100,000 abrasive composites per square inch (up to and including 7,800, 11,000, or even as many as 15,000 abrasive composites per square centimeter), although greater or lesser densities of abrasive composites may also be used.

The pyramidal to truncated pyramidal base ratio, that is, the ratio of the combined area of the bases of the pyramidal abrasive composites to the combined area of the bases of the truncated pyramidal abrasive composites may affect cut and/or finish performance of the structured abrasive articles of the present invention. For fine finishing applications, the pyramidal to truncated pyramidal base ratio is typically in a range of from 0.8 to 9, for example, in a range of from 1 to 8, 1.2 to 7, or 1.2 to 2, although ratios outside of these ranges may also be used.

Individual abrasive composites (whether pyramidal of truncated pyramidal) comprise abrasive grains dispersed in a polymeric binder.

Any abrasive grain known in the abrasive art may be included in the abrasive composites. Examples of useful abrasive grains include aluminum oxide, fused aluminum oxide, heat-treated aluminum oxide (which includes brown aluminum oxide, heat treated aluminum oxide, and white aluminum oxide), ceramic aluminum oxide, silicon carbide, green silicon carbide, alumina-zirconia, chromia, ceria, iron oxide, garnet, diamond, cubic boron nitride, and combinations thereof. For repair and finishing applications, useful abrasive grain sizes typically range from an average particle size of from at least 0.01, 0.1, 1, 3 or even 5 micrometers up to and including 35, 50, 100, 250, 500, or even as much as 1,500 micrometers, although particle sizes outside of this range may also be used.

The abrasive grain may be bonded together (by other than the binder) to form an agglomerate, such as described, for example, in U.S. Pat. No. 4,311,489 (Kressner); and U.S. Pat. Nos. 4,652,275 and 4,799,939 (both to Bloecher et al.).

The abrasive grain may have a surface treatment thereon. In some instances, the surface treatment may increase adhesion to the binder, alter the abrading characteristics of the abrasive particle, or the like. Examples of surface treatments include coupling agents, halide salts, metal oxides including silica, refractory metal nitrides, and refractory metal carbides.

The abrasive composites (whether pyramidal or truncated pyramidal) may also comprise diluent particles, typically on the same order of magnitude as the abrasive particles. Examples of such diluent particles include gypsum, marble, limestone, flint, silica, glass bubbles, glass beads, and aluminum silicate.

The abrasive particles are dispersed in a binder to form the abrasive composite. The binder can be a thermoplastic binder, however, it is typically a thermosetting binder. The binder is formed from a binder precursor. During the manufacture of the structured abrasive article, the thermosetting binder precursor is exposed to an energy source which aids in the initiation of the polymerization or curing process. Examples of energy sources include thermal energy and radiation energy which includes electron beam, ultraviolet light, and visible light.

After this polymerization process, the binder precursor is converted into a solidified binder. Alternatively for a thermoplastic binder precursor, during the manufacture of the abrasive article the thermoplastic binder precursor is cooled to a degree that results in solidification of the binder precursor. Upon solidification of the binder precursor, the abrasive composite is formed.

There are two main classes of thermosetting resins, condensation curable and addition polymerizable resins. Addition polymerizable resins are advantageous because they are readily cured by exposure to radiation energy. Addition polymerized resins can polymerize through a cationic mechanism or a free radical mechanism. Depending upon the energy source that is utilized and the binder precursor chemistry, a curing agent, initiator, or catalyst is sometimes preferred to help initiate the polymerization.

Examples of typical binder precursors include phenolic resins, urea-formaldehyde resins, aminoplast resins, urethane resins, melamine formaldehyde resins, cyanate resins, isocyanurate resins, acrylate resins (e.g., acrylated urethanes, acrylated epoxies, ethylenically unsaturated compounds, aminoplast derivatives having pendant alpha,beta-unsaturated carbonyl groups, isocyanurate derivatives having at least one pendant acrylate group, and isocyanate derivatives having at least one pendant acrylate group) vinyl ethers, epoxy resins, and mixtures and combinations thereof. The term acrylate encompasses acrylates and methacrylates. In some embodiments, the binder is selected from the group consisting of acrylics, phenolics, epoxies, urethanes, cyanates, isocyanurates, aminoplasts, and combinations thereof.

Phenolic resins are suitable for this invention and have good thermal properties, availability, and relatively low cost and ease of handling. There are two types of phenolic resins, resole and novolac. Resole phenolic resins have a molar ratio of formaldehyde to phenol of greater than or equal to one to one, typically between 1.5:1.0 to 3.0:1.0. Novolac resins have a molar ratio of formaldehyde to phenol of less than one to one. Examples of commercially available phenolic resins include those known by the trade designations "DUREZ" and "VARCUM" from Occidental Chemicals Corp., Dallas, Tex.; "RESINOX" from Monsanto Co., Saint Louis, Mo.; and "AEROFENE" and "AROTAP" from Ashland Specialty Chemical Co., Dublin, Ohio.

Acrylated urethanes are diacrylate esters of hydroxy terminated NCO extended polyesters or polyethers. Examples of commercially available acrylated urethanes include those available under the trade designations "UVITHANE 782" from Morton Thiokol Chemical, and "CMD 6600", "CMD 8400", and "CMD 8805" from UCB Radcure, Smyrna, Ga.

Acrylated epoxies are diacrylate esters of epoxy resins, such as the diacrylate esters of bisphenol A epoxy resin. Examples of commercially available acrylated epoxies include those available under the trade designations "CMD 3500", "CMD 3600", and "CMD 3700" from UCB Radcure.

Ethylenically unsaturated resins include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 g/mole and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, pentaerythritol tetraacrylate and pentaerythritol tetraacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryloyl-oxyethyl)isocyanurate, 1,3,5-tri(2-methyacryloxyethyl)-s-triazine, acrylamide, methylacrylamide, N-methylacrylamide, N,N-dimethylacrylamide, N-vinylpyrrolidone, and N-vinylpiperidone.

The aminoplast resins have at least one pendant alpha,beta-unsaturated carbonyl group per molecule or oligomer. These unsaturated carbonyl groups can be acrylate, methacrylate, or acrylamide type groups. Examples of such materials include N-(hydroxymethyl)acrylamide, N,N'-oxydimethylenebisacrylamide, ortho and para acrylamidomethylated phenol, acrylamidomethylated phenolic novolac, and combinations thereof. These materials are further described in U.S. Pat. Nos. 4,903,440 and 5,236,472 (both to Kirk et al.).

Isocyanurate derivatives having at least one pendant acrylate group and isocyanate derivatives having at least one pendant acrylate group are further described in U.S. Pat. No. 4,652,274 (Boettcher et al.). An example of one isocyanurate material is the triacrylate of tris(hydroxy ethyl)isocyanurate.

Epoxy resins have an oxirane and are polymerized by the ring opening. Such epoxide resins include monomeric epoxy resins and oligomeric epoxy resins. Examples of useful epoxy resins include 2,2-bis[4-(2,3-epoxypropoxy)-phenyl propane](diglycidyl ether of bisphenol) and materials available under the trade designations "EPON 828", "EPON 1004", and "EPON 1001F" from Shell Chemical Co., Houston, Tex.; and "DER-331", "DER-332", and "DER-334" from Dow Chemical Co., Midland, Mich. Other suitable epoxy resins include glycidyl ethers of phenol formaldehyde novolac commercially available under the trade designations "DEN-431" and "DEN-428" from Dow Chemical Co.

The epoxy resins of the invention can polymerize via a cationic mechanism with the addition of an appropriate cationic curing agent. Cationic curing agents generate an acid source to initiate the polymerization of an epoxy resin. These cationic curing agents can include a salt having an onium cation and a halogen containing a complex anion of a metal or metalloid.

Other cationic curing agents include a salt having an organometallic complex cation and a halogen containing complex anion of a metal or metalloid which are further described in U.S. Pat. No. 4,751,138 (Tumey et al.). Another example is an organometallic salt and an onium salt is described in U.S. Pat. No. 4,985,340 (Palazzotto et al.); U.S. Pat. No. 5,086,086 (Brown-Wensley et al.); and U.S. Pat. No. 5,376,428 (Palazzotto et al.). Still other cationic curing agents include an ionic salt of an organometallic complex in which the metal is selected from the elements of Periodic Group IVB, VB, VIB, VIIB and VIIIB which is described in U.S. Pat. No. 5,385,954 (Palazzotto et al.).

Regarding free radical curable resins, in some instances it is preferred that the abrasive slurry further comprise a free radical curing agent. However in the case of an electron beam energy source, the curing agent is not always required because the electron beam itself generates free radicals.

Examples of free radical thermal initiators include peroxides, e.g., benzoyl peroxide, azo compounds, benzophenones, and quinones. For either ultraviolet or visible light energy source, this curing agent is sometimes referred to as a photoinitiator. Examples of initiators, that when exposed to ultraviolet light generate a free radical source, include but are not limited to those selected from the group consisting of organic peroxides, azo compounds, quinones, benzophenones, nitroso compounds, acryl halides, hydrozones, mercapto compounds, pyrylium compounds, triacrylimidazoles, bisimidazoles, chloroalkytriazines, benzoin ethers, benzil ketals, thioxanthones, and acetophenone derivatives, and mixtures thereof. Examples of initiators that, if exposed to visible radiation, generate a free radical source can be found in U.S. Pat. No. 4,735,632 (Oxman et al.). One suitable initiator for use with visible light is available under the trade designation "IRGACURE 369" from Ciba Specialty Chemicals, Tarrytown, N.Y.

Structured abrasive articles are typically prepared by forming a slurry of abrasive grains and a solidifiable or polymerizable precursor of the abovementioned binder resin (i.e., a binder precursor), contacting the slurry with a backing and solidifying and/or polymerizing the binder precursor (e.g., by exposure to an energy source) in a manner such that the resulting structured abrasive article has a plurality of shaped abrasive composites affixed to the backing. Examples of energy sources include thermal energy and radiant energy (including electron beam, ultraviolet light, and visible light).

The abrasive slurry is made by combining together by any suitable mixing technique the binder precursor, the abrasive grains and the optional additives. Examples of mixing techniques include low shear and high shear mixing, with high shear mixing being preferred. Ultrasonic energy may also be utilized in combination with the mixing step to lower the abrasive slurry viscosity. Typically, the abrasive particles are gradually added into the binder precursor. The amount of air bubbles in the abrasive slurry can be minimized by pulling a vacuum either during or after the mixing step. In some instances, it is useful to heat, generally in the range of 30 to 70° C., the abrasive slurry to lower the viscosity.

For example, in one embodiment, the slurry may be coated directly onto a production tool having shaped cavities (corresponding to the desired structured abrasive layer) therein, and brought into contact with the backing, or coated on the backing and brought to contact with the production tool. For example, the surface of the tool may consist essentially of a close packed array of cavities comprising: pyramidal cavities (e.g., selected from the group consisting of three-sided pyramidal cavities, four-sided pyramidal cavities, five-sided pyramidal cavities, six-sided pyramidal cavities, and combinations thereof); and truncated pyramidal cavities (e.g., selected from the group consisting of truncated three-sided pyramidal cavities, truncated four-sided pyramidal cavities, truncated five-sided pyramidal cavities, truncated six-sided pyramidal cavities, and combinations thereof). In some embodiments, the ratio of the depth of the truncated pyramidal cavities to the depth of the pyramidal cavities is in a range of from 0.2 to 0.35. In some embodiments, the depth of the pyramidal cavities is in a range of from 1 to 10 micrometers. In some embodiments, the pyramidal and truncated pyramidal cavities each have an areal density of greater than or equal to 150 cavities per square centimeter.

In this embodiment, the slurry is typically then solidified (e.g., a least partially cured) or cured while it is present in the cavities of the production tool, and the backing is separated from the tool thereby forming a structured abrasive article.

The production tool can be a belt, a sheet, a continuous sheet or web, a coating roll such as a rotogravure roll, a sleeve mounted on a coating roll, or die. The production tool can be composed of metal, (e.g., nickel), metal alloys, or plastic. The metal production tool can be fabricated by any conventional technique such as, for example, engraving, bobbing, electroforming, or diamond turning.

A thermoplastic tool can be replicated off a metal master tool. The master tool will have the inverse pattern desired for the production tool. The master tool can be made in the same manner as the production tool. The master tool is preferably made out of metal, e.g., nickel and is diamond turned. The thermoplastic sheet material can be heated and optionally along with the master tool such that the thermoplastic material is embossed with the master tool pattern by pressing the two together. The thermoplastic can also be extruded or cast onto the master tool and then pressed. The thermoplastic material is cooled to solidify and produce the production tool. Examples of preferred thermoplastic production tool materials include polyester, polycarbonates, polyvinyl chloride, polypropylene, polyethylene and combinations thereof. If a thermoplastic production tool is utilized, then care must be taken not to generate excessive heat that may distort the thermoplastic production tool.

The production tool may also contain a release coating to permit easier release of the abrasive article from the production tool. Examples of such release coatings for metals include hard carbide, nitrides or borides coatings. Examples of release coatings for thermoplastics include silicones and fluorochemicals.

Further details concerning structured abrasive articles having precisely shaped abrasive composites, and methods for their manufacture may be found, for example, in U.S. Pat. No. 5,152,917 (Pieper et al.); U.S. Pat. No. 5,435,816 (Spurgeon et al.); U.S. Pat. No. 5,672,097 (Hoopman); U.S. Pat. No. 5,681,217 (Hoopman et al.); U.S. Pat. No. 5,454,844 (Hibbard et al.); U.S. Pat. No. 5,851,247 (Stoetzel et al.); and U.S. Pat. No. 6,139,594 (Kincaid et al.); the disclosures of which are incorporated herein by reference.

In another embodiment, a slurry comprising a polymerizable binder precursor, abrasive grains, and a silane coupling agent may be deposited on a backing in a patterned manner (e.g., by screen or gravure printing), partially polymerized to render at least the surface of the coated slurry plastic but non-flowing, a pattern embossed upon the partially polymerized slurry formulation, and subsequently further polymerized (e.g., by exposure to an energy source) to form a plurality of shaped abrasive composites affixed to the backing. Such embossed structured abrasive articles prepared by this and related methods are described, for example, in U.S. Pat. No. 5,833,724 (Wei et al.); U.S. Pat. No. 5,863,306 (Wei et al.); U.S. Pat. No. 5,908,476 (Nishio et al.); U.S. Pat. No. 6,048,375 (Yang et al.); U.S. Pat. No. 6,293,980 (Wei et al.); and U.S. Pat. Appl. Pub. No. 2001/0041511 (Lack et al.); the disclosures of which are incorporated herein by reference.

The back side of the abrasive article may be printed with pertinent information according to conventional practice to reveal information such as, for example, product identification number, grade number, and/or manufacturer. Alternatively, the front surface of the backing may be printed with this same type of information. The front surface can be printed if the abrasive composite is translucent enough for print to be legible through the abrasive composites.

Structured abrasive articles according to the present invention may optionally have an attachment interface layer affixed to the second major surface of the backing to facilitate securing the structured abrasive article to a support pad or back-up pad secured to a tool such as, for example, a random orbit sander. The optional attachment interface layer may be an adhesive (e.g., a pressure sensitive adhesive) layer or a double-sided adhesive tape. The optional attachment interface layer may be adapted to work with one or more complementary elements affixed to the support pad or back up pad in order to function properly. For example, the optional attachment interface layer may comprise a loop fabric for a hook and loop attachment (e.g., for use with a backup or support pad having a hooked structure affixed thereto), a hooked structure for a hook and loop attachment (e.g., for use with a backup or support pad having a looped fabric affixed thereto), or an intermeshing attachment interface layer (e.g., mushroom type interlocking fasteners designed to mesh with a like mushroom type interlocking fastener on a back up or support pad). Further details concerning such attachment interface layers may be found, for example, in U.S. Pat. No. 4,609,581 (Ott); U.S. Pat. No. 5,152,917 (Pieper et al.); U.S. Pat. No. 5,254,194 (Ott); U.S. Pat. No. 5,454,844 (Hibbard et al.); U.S. Pat. No. 5,672,097 (Hoopman); U.S. Pat. No. 5,681,217 (Hoopman et al.); and U.S. Pat. Appl. Pub. Nos. 2003/0143938 (Braunschweig et al.) and 2003/0022604 (Annen et al.).

Likewise, the second major surface of the backing may have a plurality of integrally formed hooks protruding therefrom, for example, as described in U.S. Pat. No. 5,672,186 (Chesley et al.). These hooks will then provide the engagement between the structured abrasive article and a back up pad that has a loop fabric affixed thereto.

Structured abrasive articles according to the present invention can be any shape, for example, round (e.g., a disc), oval, scalloped edges, or rectangular (e.g., a sheet) depending on the particular shape of any support pad that may be used in conjunction therewith, or they may have the form of an endless belt. The structured abrasive articles may have slots or slits therein and may be provided with perforations (e.g., a perforated disk).

Structured abrasive articles according to the present invention are generally useful for abrading a workpiece, and especially those workpieces having a hardened polymeric layer thereon.

The workpiece may comprise any material and may have any form. Examples of materials include metal, metal alloys, exotic metal alloys, ceramics, painted surfaces, plastics, polymeric coatings, stone, polycrystalline silicon, wood, marble, and combinations thereof. Examples of workpieces include molded and/or shaped articles (e.g., optical lenses, automotive body panels, boat hulls, counters, and sinks), wafers, sheets, and blocks.

Structured abrasive articles according to the present invention are typically useful for repair and/or polishing of polymeric coatings such as motor vehicle paints and clearcoats (e.g., automotive clearcoats), examples of which include: polyacrylic-polyol-polyisocyanate compositions (e.g., as described in U.S. Pat. No. 5,286,782 (Lamb, et al.); hydroxyl functional acrylic-polyol-polyisocyanate compositions (e.g., as described in U.S. Pat. No. 5,354,797 (Anderson, et al.); polyisocyanate-carbonate-melamine compositions (e.g., as described in U.S. Pat. No. 6,544,593 (Nagata et al.); and high solids polysiloxane compositions (e.g., as described in U.S. Pat. No. 6,428,898 (Barsotti et al.)).

Depending upon the application, the force at the abrading interface can range from about 0.1 kg to over 1000 kg. Generally, this range is between 1 kg to 500 kg of force at the abrading interface. Also, depending upon the application there may be a liquid present during abrading. This liquid can be water and/or an organic compound. Examples of typical organic compounds include lubricants, oils, emulsified organic compounds, cutting fluids, surfactants (e.g., soaps, organosulfates, sulfonates, organophosphonates, organophosphates), and combinations thereof. These liquids may also contain other additives such as defoamers, degreasers, corrosion inhibitors, and combinations thereof.

Structured abrasive articles according to the present invention may be used, for example, with a rotary tool that rotates about a central axis generally perpendicular to the structured abrasive layer, or with a tool having a random orbit (e.g., a random orbital sander), and may oscillate at the abrading interface during use. In some instances, this oscillation may result in a finer surface on the workpiece being abraded.

Objects and advantages of this invention are further illustrated by the following non-limiting examples, but the particular materials and amounts thereof recited in these examples, as well as other conditions and, details, should not be construed to unduly limit this invention.

EXAMPLES

Unless otherwise noted, all parts, percentages, ratios, etc. in the examples and the rest of the specification are by weight, and all reagents used in the examples were obtained, or are available, from general chemical suppliers such as, for example, Sigma-Aldrich Company, Saint Louis, Mo., or may be synthesized by conventional methods.

The following abbreviations are used in the Examples below:

ACR1: 2-phenoxy acrylate, commercially available under the trade designation "SR339" from Sartomer Company, Inc., Exton, Pa.;

ACR2: trimethylolpropane triacrylate, commercially available under the trade designation "SR351" from Sartomer Company, Inc.;

ACR3: a urethane-acrylate resin, commercially available under the trade designation "CN973J75" from Sartomer Company, Inc.;

BUP1: a 1.25-inch (31.8 mm) diameter vinyl face backup pad having a hardness of 40-60 Shore 00, commercially available under the trade designation "3M FINESSE-IT STIKIT BACKUP PAD, PART No. 02345" from 3M Company;

BUP2: BUP1, wherein the backup pad face was cut to ⅞-inch (22.2 mm) diameter, after which HK1 was laminated to the vinyl face with a pressure sensitive adhesive (PSA);

BUP3: a backup pad made according to the method described in BUP2, except the backup pad was ¾-inch (19.1 mm) diameter;

BUP4: a backup pad made according to the method described in BUP2, except the hardness was reduced to 20-40 Shore 00;

BUP5: a backup pad made according to the method described in BUP2, except the hardness was increased to 50 Shore A;

CPA1: gamma-methacryloxypropyltrimethoxysilane, commercially available under the trade designation "A-174" from Crompton Corporation, Middlebury, Conn.;

DSP1: anionic polyester dispersant, obtained under the trade designation "HYPERMER KD-10" from Uniqema, New Castle, Del.;

EPM1: expandable polymeric microspheres, commercially available under the trade designation "MICROPEARL F80-SD1," from Pierce-Stevens Corp., Buffalo, N.Y.;

HK1: nylon hook material for a hook and loop fastener, commercially available under the trade designation "MOLDED J-HOOK (CFM22)" from Velcro USA, Inc., Manchester, N.H.;

LP1: a 70 grams/meter$^2$ (gsm) loop fabric material, commercially available under the trade designation "100% POLYAMIDE DAYTONA BRUSHED NYLON LOOP" from Sitip SpA Industrie, Cene, Italy;

MINI: green silicon carbide mineral, commercially available under the trade designation "GC 4000 GREEN SILICON CARBIDE" from Fujimi Corporation, Elmhurst, Ill.;

SF1: a 0.25% aqueous solution of a surfactant, 1,4-bis(2-ethylhexyl)sodium sulfosuccinate obtained under the trade designation "TRITON GR-5M" from Dow Chemical Company;

TP1: an automotive clear coat test panel, commercially available under the trade designation "PPG 5002U DIAMOND COAT" from ACT Laboratories, Hillsdale, Mich.;

TP2: an automotive clear coat test panel, commercially available under the trade designation "PPG CERAMIC CLEAR" from PPG Industries; Alison Park, Pa.;

TP3: an automotive clear coat test panel, commercially available under the trade designation "DUPONT GEN IV" from ACT Laboratories; and UVI1: acylphosphine oxide, commercially available under the trade designation "LUCERIN TPO-L" from BASF Corporation, Florham Park, N.J.

Example 1

Figure 2:
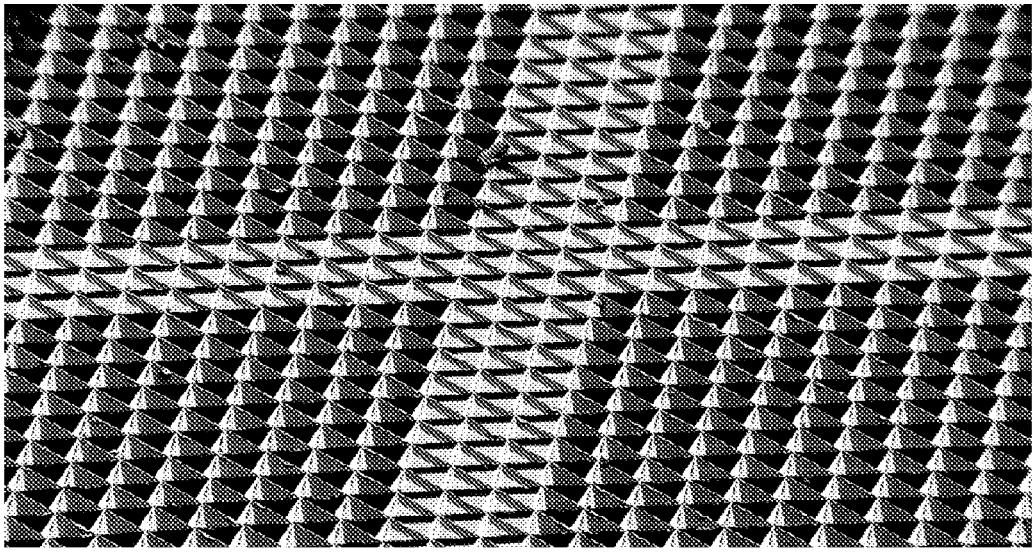
FIG. 2 is a digital micrograph of polypropylene tooling used to prepare Example 1.
Figure 3:
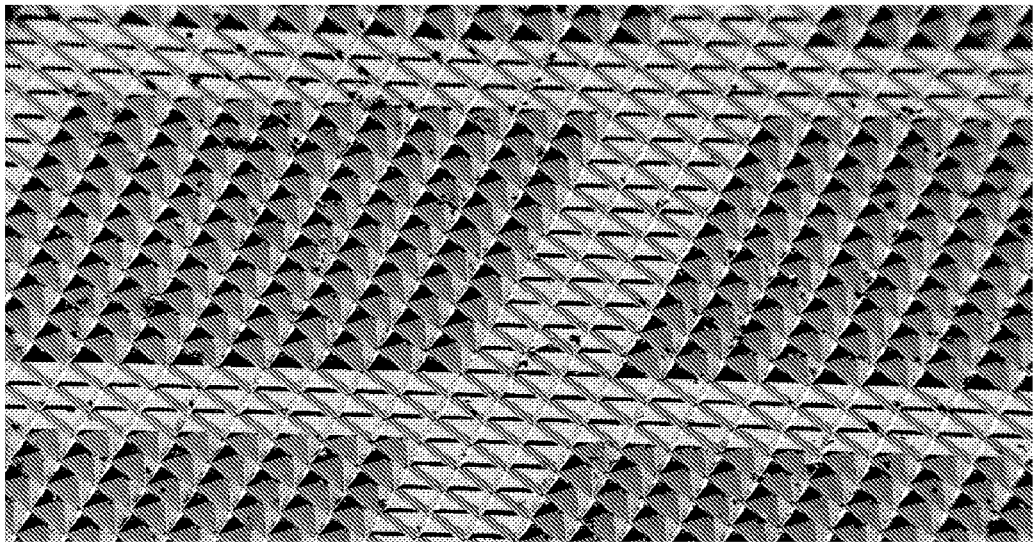
FIG. 3 is a digital micrograph of the structured abrasive article prepared according to Example 1.

An abrasive slurry defined in parts by weight, was prepared as follows: 13.2 parts ACR1, 20.0 parts ACR2, 0.5 parts DSP1, 2.0 part CPA1, 1.1 parts UVI1 and 63.2 parts MIN1 were homogeneously dispersed for approximately 15 minutes at 20° C. using a laboratory air mixer. The slurry was applied via knife coating to a 12-inch (30.5 cm) wide microreplicated polypropylene tooling having uniformly distributed, close packed, alternating 34 degree helical cut, pyramidal arrays having 11 by 11 rows of base width 3.3 mils by 3.3 mils (83.8 by 83.8 micrometers) by 2.5 mils (63.5 micrometers) depth, separated by 3 by 3 rows of the same pyramidal array truncated to a depth of 0.83 mil (21 micrometers), as shown in FIG. 2. The tool was prepared from a corresponding master roll generally according to the procedure of U.S. Pat. No. 5,975,987 (Hoopman et al.). The slurry filled polypropylene tooling was then laid on the a 12-inch (30.5-cm) wide web of ethylene acrylic acid primed polyester film, 3.71 mil (94.2 micrometers) thick, obtained under the trade designation "MA370M" from 3M Company, passed through a nip roll (nip pressure of 90 pounds per square inch (psi) (620.5 kilopascals (kPa)) for a 10 inch (25.4 cm) wide web), and irradiated with an ultraviolet (UV) lamp, type "D" bulb, from Fusion Systems Inc., Gaithersburg, Md., at 600 Watts/inch (236 Watts/cm) while moving the web at 30 feet/minute (fpm) (9.14 meters/minute). The polypropylene tooling was separated from the ethylene acrylic acid primed polyester film, resulting in a fully cured precisely shaped abrasive layer adhered to ethylene acrylic acid primed polyester film as shown in FIG. 3. Pressure sensitive adhesive was laminated to the backside (opposite that abrasive layer) of the film, then a sheet of LP1 was laminated to the pressure sensitive adhesive. Various disc sizes, ranging in diameter from 0.75-inch (1.91-cm) to 1.25-inch (3.18-cm) were then die cut from the abrasive material.

Comparative Example A

Figure 4:
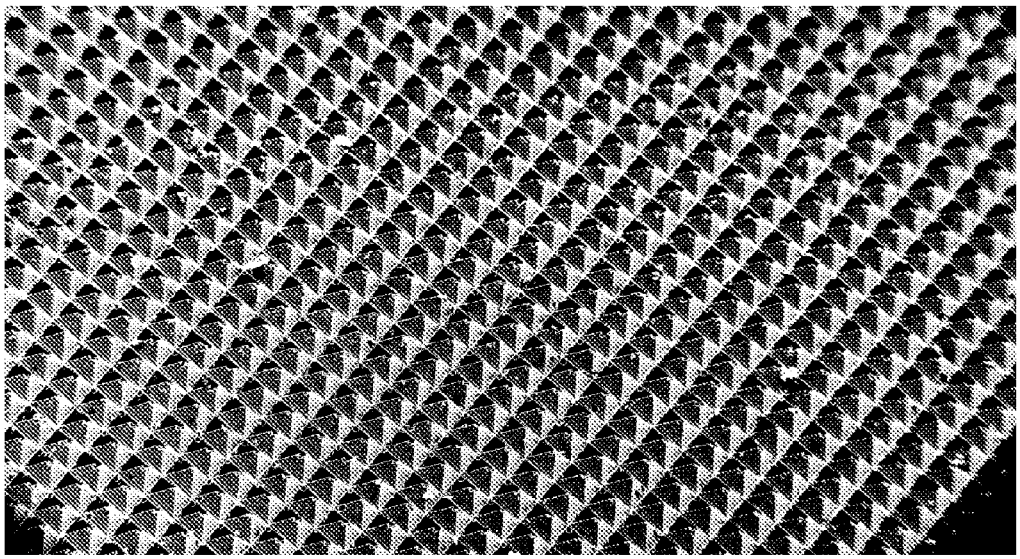
FIG. 4 is a digital micrograph of the structured abrasive article prepared according to Comparative Example A.

A 1.25-inch (3.18-cm) structured abrasive disc having an abrasive layer composed of a close packed off-set array of tetrahedral abrasive composites each having a base width of 92 micrometers, a height of 63 micrometers, and composed of green silicon carbide abrasive grains (3.0 micrometers mean particle size) dispersed in a polymeric binder, obtained under the trade designation "3M TRIZACT FILM 466LA, A3 DISC" from 3M Company. A digital micrograph of the resultant structured abrasive article is shown in FIG. 4.

Comparative Example B

A structured abrasive disc as described in Comparative Example A, wherein the disc was die cut to 1-inch (2.54 cm) diameter, after which loop material LP1 was laminated to the disc using pressure sensitive adhesive.

Comparative Example C

A resin pre-mix was prepared by combining at 20° C., 36.4 parts ACR1, 60.8 parts ACR3 and 2.8 parts UVI1 on a "DISPERSATOR" mixer, obtained from Premier Mill Corp., Reading, Pa., until air bubbles had dissipated. EPM1 (3.4 parts) was then added to the resin pre-mix and combined to form a homogeneous slurry, and the slurry was heated at 160° C. for 60 minutes. The slurry was then applied, via knife coating, to a microreplicated polypropylene tooling having square posts, 1.58 mm by 1.58 mm and depth of 0.36 mm, and having a 45 percent bearing area (that is, the percentage of the total projected surface area occupied by the tops of the posts). The slurry filled tooling was then laminated face down to the smooth side of a 3-mil (80-micrometer) ethylene acrylic acid primed polyester film and passed through a set of rubber nip rolls at a rate of 26 cm/min and a nip pressure of 40 psi (280 kPa). The slurry was then cured by passing twice through a UV processor, available from American Ultraviolet Company, Murray Hill, N.J., using two V-bulbs in sequence operating at 400 Watts/inch (157.5 Watts/cm) and a web speed of 3 feet per minute (fpm) (9 m/min). The polypropylene tooling was then separated from the ethylene acrylic acid primed polyester film, resulting in a macrostructured polymeric backing having mirror image of the tooling.

Figure 5:
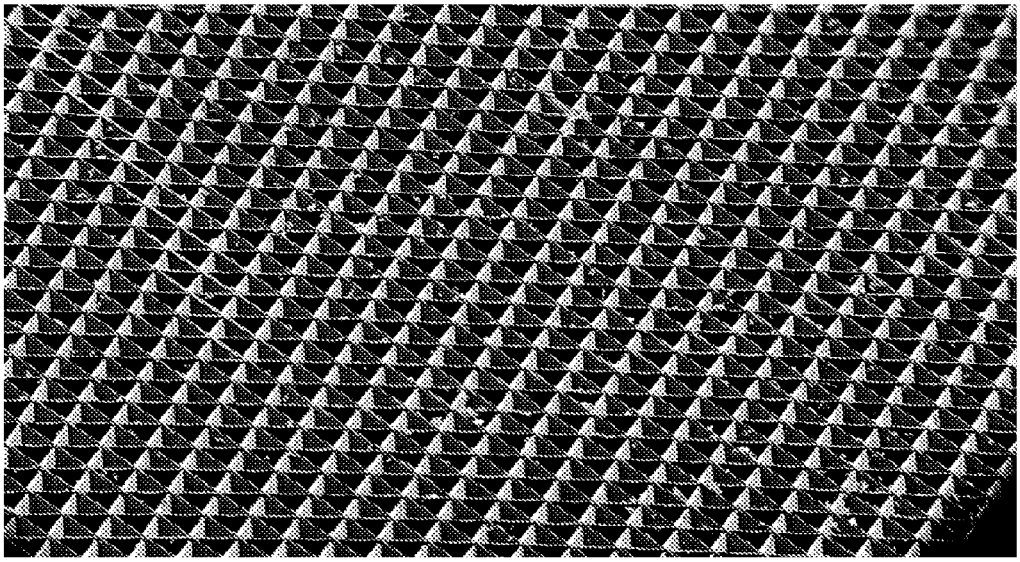
FIG. 5 is a digital micrograph of polypropylene tooling used to prepare Comparative Example C.
Figure 6:
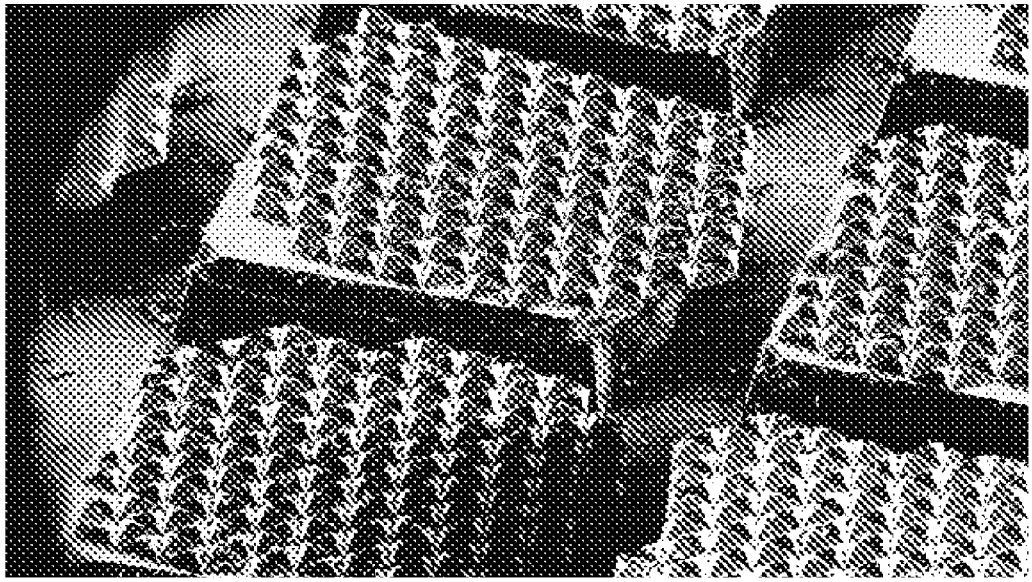
FIG. 6 is a digital micrograph of a structured abrasive article of the Comparative Example C.

An abrasive slurry as described in Example 1 was prepared and applied via knife coating to a 12-inch (30-cm) wide microreplicated polypropylene tooling having uniformly distributed, close packed, pyramidal array having a square base width of 92 by 92 micrometers and a depth of 63 micrometers, as shown in FIG. 5. The abrasive slurry filled polypropylene tooling was then laid on the textured surface of the macrostructured polymeric backing and passed through a nip roll (nip pressure of 90 psi (620 kPa) for a 10-inch (25-cm) wide web and irradiated with an ultraviolet (UV) lamp, type "D" bulb, from Fusion Systems Inc., Gaithersburg, Md., at 600 Watts per inch (236 Watts per cm) while moving the web at 30 fpm (9.14 meters/minute). The polypropylene tooling was removed, resulting in a cured precisely shaped abrasive coating adhered to the textured face of the macrostructured polymeric backing as shown in FIG. 6. A pressure sensitive adhesive was laminated to the opposing, planar surface, of the structured polymeric backing and 1.25-inch (3.18-cm) diameter discs were then die cut from the abrasive material.

Manual Denibbing Evaluation

Example 1 and Comparative Example A were evaluated for their ability to remove dust nibs (de-nibbing) in automotive clearcoat test panel TP1 without concomitant leveling of the surrounding orange peel. Dust nibs in the cured clearcoat were identified visually and lightly sprayed with either water or SF1. A 1.25-inch (3.18-cm) specimen of the structured abrasive article to be evaluated was attached to a backup pad (as reported in Table 1), which was then attached to an air-driven random orbit sander, model number "57502" obtained from Dynabrade, Inc., Clarence, N.Y. A given dust nib (<1 mm outside diameter) on the test panel was abraded in 3 second abrading intervals, using an air line pressure of 90 pounds per square inch (620 kPa), with the center of the abrasive article using the weight of the tool to generate the down force. After each abrading interval, the test panel then wiped clean with isopropanol. Visual examination of the abraded test panel at the site of the dust nib was recorded. Results are reported in Table 1 (below).

TABLE 1

| Specimen | Backup Pad Hardness | Wetting Medium | Clearcoat Test Panel | De-nibbing Efficacy |
|---|---|---|---|---|
| Comparative Example B | BUP4 | Water | TP1 | Partially removed |
| Example 1 | BUP4 | Water | TP1 | Completely removed |
| Comparative Example B | BUP2 | SF1 | TP2 | Partially removed |
| Example 1 | BUP2 | SF1 | TP2 | Completely removed |
| Comparative Example B | BUP5 | SF1 | TP2 | Partially removed |
| Example 1 | BUP5 | SF1 | TP2 | Completely removed |

Examples 2-3

Example 2 was prepared according to the method described in Example 1, except loop attachment material LP1 was not applied to the backside of the film support. Example 3 was prepared according to Example 2, except the finished material was cut with a 10-point scalloped edge die having an inner diameter of 1.25 inches (3.18 cm) and an apex diameter of 1.44 inches (3.65 cm).

Average Total Cut and Roughness

Specimens of Examples 2 and 3, and Comparative Example A, were attached to backup pad BUP1 and evaluated on a 2-inch by 18-inch (5-cm by 46-cm) section of test panel TP3 according to the conditions used in Example 1 above. Down force of the sander was 5 pounds (2.3 kg). The average total cut was the reduction in thickness, in micrometers, after abrading for 3 seconds, replicated 10 times on fresh sections of the same test panel. SF1 was automatically sprayed for approximately 1-2 seconds onto the surface of the test disc between each replicate. The thickness of the coating on the test panel was measured using a model "ELCOMETER 256F" coating thickness gauge, available from Elcometer Inc., Rochester Hills, Mich. The surface roughness of the coating on the test panel was measured using a "PERTHOMETER", available from Feinpruf GmbH, Gottingen, Germany, and is reported as $R_Z$, the arithmetic average of the scratch depth. Results are reported in Table 2 (below).

TABLE 2

| Specimen | Average Total Cut, micrometers | $R_Z$, micrometers |
|---|---|---|
| Example 2 | 0.75 | 18.0 |
| Example 3 | 0.85 | 17.8 |
| Comparative Example A | 0.66 | 18.0 |

Example 1 and Comparative Example B were subjected to the same abrading procedure as described in the manual denibbing evaluation above, except that cut life and finish were measured instead of denibbing. Cut Life is defined as the number of uniformly circular sanded test areas. TP2 was used as the test panel and SF1 was used as the sanding medium. Results of testing are reported in Table 3 (below).

TABLE 3

| Specimen | Backup Pad | Disc Size, Inches (cm) | Cut life Number of sanding spots | $R_Z$, micrometers |
|---|---|---|---|---|
| Comparative Example B | BUP4 | 1.0 (2.54) | 1 | 15 |
| Example 1 | BUP4 | 1.0 (2.54) | 1 | 15 |
| Comparative Example B | BUP2 | 1.0 (2.54) | 1 | 12 |
| Example 1 | BUP2 | 1.0 (2.54) | 9 | 10 |
| Comparative Example B | BUP3 | 0.75 (1.91) | 5 | 12 |
| Example 1 | BUP3 | 0.75 (1.91) | 8 | 11 |
| Comparative Example B | BUP5 | 1.0 (2.54) | 5 | 12 |
| Example 1 | BUP5 | 1.0 (2.54) | 9 | 12 |

Specimens of Example 1 and Comparative Examples B and C were subjected to the manual cut life and evaluation described above, except water replaced SF1 as the sanding medium and disc size was 1.25 inches (3.18 cm). Results are reported in Table 4 (below)

TABLE 4

| Specimen | Backup Pad | Clearcoat Test Panel | Cut life Number of sanding spots | $R_Z$, micrometers |
|---|---|---|---|---|
| Comparative Example A | BUP1 | TP3 | 5 | 15 |
| Comparative Example C | BUP1 | TP3 | 4 | 14 |
| Example 2 | BUP1 | TP3 | 4 | 14 |

Various modifications and alterations of this invention may be made by those skilled in the art without departing from the scope and spirit of this invention, and it should be understood that this invention is not to be unduly limited to the illustrative embodiments set forth herein.

What is claimed is:

1. A structured abrasive article comprising:

a backing having first and second opposed major surfaces; and a structured abrasive layer having an outer boundary and affixed to the first major surface of the backing, the structured abrasive layer comprising:

a plurality of raised abrasive regions, each raised abrasive region consisting essentially of close-packed pyramidal abrasive composites having a first height;

a network consisting essentially of close-packed truncated pyramidal abrasive composites having a second height, wherein the network continuously abuts and separates the raised abrasive regions from one another and is coextensive with the outer boundary;

wherein the pyramidal abrasive composites and the truncated pyramidal abrasive composites each comprise abrasive particles and a binder, and wherein the first height is greater than the second height.

2. A structured abrasive article according to claim 1, wherein the network has a least width of at least twice the height of the pyramidal abrasive composites.

3. A structured abrasive article according to claim 1, wherein the ratio of the second height to the first height is in a range of from 0.2 to 0.35.

4. A structured abrasive article according to claim 1, wherein the pyramidal abrasive composites are selected from the group consisting of three-sided pyramids, four-sided pyramids, five-sided pyramids, six-sided pyramids, and combinations thereof.

5. A structured abrasive article according to claim 1, wherein the truncated pyramidal abrasive composites are selected from the group consisting of truncated three-sided pyramids, truncated four-sided pyramids, truncated five-sided pyramids, truncated six-sided pyramids, and combinations thereof.

6. A structured abrasive article according to claim 1, wherein the pyramidal abrasive composites have an areal density of greater than or equal to 150 pyramidal abrasive composites per square centimeter.

7. A structured abrasive article according to claim 1, wherein the height of the pyramidal abrasive composites is in a range of from 1 to 10 mils.

8. A structured abrasive article according to claim 1, further comprising an attachment interface layer affixed to the second major surface of the backing.

9. A structured abrasive article according to claim 1, wherein the structured abrasive article comprises an abrasive disk.

10. A structured abrasive article according to claim 1, wherein the binder is selected from the group consisting of acrylics, phenolics, epoxies, urethanes, cyanates, isocyanurates, aminoplasts, and combinations thereof.

11. A structured abrasive article according to claim 1, wherein the abrasive particles are selected from the group consisting of aluminum oxide, fused aluminum oxide, heat-treated aluminum oxide, ceramic aluminum oxide, silicon carbide, green silicon carbide, alumina-zirconia, ceria, iron oxide, garnet, diamond, cubic boron nitride, and combinations thereof.

12. A structured abrasive article according to claim 1, wherein the structured abrasive article has a ratio of the combined area of the bases of the pyramidal abrasive composites to the combined area of the bases of the truncated pyramidal abrasive composites in a range of from 0.8 to 9.

13. A structured abrasive article according to claim 1, wherein the abrasive particles have an average particle size in a range of from 0.01 to 1500 micrometers.

* * * * *